US006086123A

United States Patent [19]

Sowinski et al.

[11] Patent Number: 6,086,123

[45] **Date of Patent: *Jul. 11, 2000**

[54] ANIMAL WASTE REMOVAL SYSTEM

[76] Inventors: Thomas J. Sowinski, 2456 S. 93rd St., Milwaukee, Wis. 53227; Eric S. Klossowski, 1104 Lincoln Ave., Waukesha, Wis. 53186

[ * ] Notice: This patent issued on a continued prosecution application filed under 37 CFR 1.53(d), and is subject to the twenty year patent term provisions of 35 U.S.C. 154(a)(2).

[21] Appl. No.: 09/036,156

[22] Filed: Mar. 6, 1998

[51] Int. Cl.[7] ..... A01K 29/00; E01H 1/12

[52] U.S. Cl. ..... 294/1.3

[58] Field of Search ..... 294/1.3–1.5, 25, 294/55; 15/104.8, 257.1, 257.6; 383/42, 63; D30/161, 162

[56] References Cited

U.S. PATENT DOCUMENTS

| | | | |
|---|---|---|---|
| 3,767,247 | 10/1973 | Wetzler | 294/1.3 |
| 3,786,780 | 1/1974 | Pezzino | 294/1.5 |
| 4,010,970 | 3/1977 | Campbell | 294/1.5 |
| 4,136,900 | 1/1979 | Thompson | 294/1.5 |
| 4,247,139 | 1/1981 | Grieb | 294/1.4 |
| 4,257,635 | 3/1981 | Mainprice | 294/1.4 |
| 4,323,272 | 4/1982 | Fortier | 294/1.4 |
| 4,641,873 | 2/1987 | Nurnberger | 294/1.4 |
| 4,718,707 | 1/1988 | Greenhut | 294/1.4 |
| 4,900,077 | 2/1990 | Beck | 294/1.3 |
| 5,385,376 | 1/1995 | Malaspina et al. | 294/1.3 |
| 5,503,442 | 4/1996 | Lee | 294/1.4 |
| 5,669,645 | 9/1997 | Chuang | 294/1.3 |

FOREIGN PATENT DOCUMENTS

| | | | |
|---|---|---|---|
| 3423339 | 7/1985 | Germany | 294/1.3 |
| 4007051 | 9/1991 | Germany | 294/1.3 |
| 651873 | 10/1985 | Switzerland | 294/1.3 |
| 661077 | 6/1987 | Switzerland | 294/1.3 |

*Primary Examiner*—Johnny D. Cherry
*Attorney, Agent, or Firm*—Michael Best & Friedrich, LLC

[57] ABSTRACT

A sanitary animal waste material removal system has a scooper with a pair of arms pivotably connected at a pivot. Each of the arms has a scooped jaw extending perpendicularly from it and a handle portion. The arms are biased in a closed position by a biasing mechanism such as a spring located at the pivot point. A disposable bag having a pair of loops is fit over the jaws. One loop is slid over each jaw. The bag has a pouch with pleated ends, an opening, two sides, and a bottom. In use, the pet owner first slides a retainer bag over the scooped jaws. The flattened main body of the bag fits between the jaws and, thus, the jaws must be opened slightly as the loops are slid onto each jaw. Then, in order to pick up a deposit of feces from the ground, the owner opens the jaws by squeezing the handle portions of the arms together causing a pivoting of the arms about the pivot point and an opening of the jaws. As the jaws open, the resealable sealing mechanism opens. For example, in a device equipped with Velcro® fasteners, the hook portion of the hook and loop fastener is released from the loop portion. The bag then opens with the jaws and once opened, the pet owner can scoop up the feces by positioning the open jaws around the feces and releasing the spring biased arms. The arms then close to scoop the feces into the disposable bag, engage the sealing mechanism, and retain the feces in the bag. The pet owner can then dispose of the filled bag by opening the jaws slightly and sliding the full bag off the jaws into a waste receptacle with a small flick of the wrist.

14 Claims, 3 Drawing Sheets

ANIMAL WASTE REMOVAL SYSTEM

BACKGROUND OF THE INVENTION

This invention relates generally to waste removal systems, and in particular to a waste removal system useful for picking up and disposing of pet feces.

Ownership of a household pet such as a dog can be a very rewarding experience for both the pet owner and the pet. However, the responsibility for the care of such an animal brings with it the unpleasant task of caring for the animal's basic need for waste excretion. Many dog owners attend to this task by walking the dog in a public park or along a city street. In many cities and parks, the law and/or the need for cleanliness requires that the dog owner clean up his dog's feces. Additionally, dog owners who have a backyard or other land sufficient for allowing the dog to exercise and to attend to its "business" must from time to time clean up the feces that is left on the ground by the animal.

Many devices have been created to attend to the cleaning and disposal of animal feces. Most of these devices are in the form of scoops or small shovels. Some of these devices, such as the ones disclosed in U.S. Pat. Nos. 4,641,873; 4,900,077; 5,503,442; 4,247,139; 4,718,707; and 4,136,900, also include a disposable bag or pouch for use with the waste removal device. However, such devices suffer from several drawbacks. One drawback is that many of these devices require two-hand operation, which can be difficult or awkward for a pet owner to accomplish while holding a leash or otherwise restraining the pet. Another drawback is that many of them are designed so that their scoops or shovels come directly into contact with the feces being picked up. Thus, the devices must be cleaned or wrapped before they can be stored, for example, in the trunk of an automobile. As can be appreciated by one of skill in the art, cleaning or otherwise handling a soiled "pooper scooper" is not an appealing task. Other shortcomings of previous devices include their relative high complexity and, thus, high cost.

Accordingly, a need exists for an animal waste material removal system that is easy to use, is sanitary (in that it is not soiled in the pick-up operation), is easily stored, and is relatively inexpensive. The present invention relates to an improved system which is capable of easily and sanitarily cleaning up animal waste and solves the problems raised or not solved by existing material removal systems. Of course, the present invention has a multitude of uses involving the removal and disposal of materials other than animal feces.

SUMMARY OF THE INVENTION

It is therefore an object of the present invention to provide a sanitary animal waste material removal system that is easily used and stored and is inexpensive.

The sanitary animal waste removal system of the present invention provides the above-identified and many additional objects by providing a system that can be easily and sanitarily used, and is easily stored. As described in more detail below and shown in the accompanying drawings, the system of the present invention includes a pair of arms each with a scooped jaw and handle. The arms are joined at a pivot such that squeezing the handles together effectuates opening of the jaws. A spring or other biasing mechanism to bias the arms in a closed position is posited at or near the pivot. A paper, plastic, or other disposable waste retaining bag ("disposable bag") is disengageably retained on the jaws of the device by means of two loops; one loop fits around each jaw.

The bag has a series of fan folds or pleats in each of its ends. The pleats meet at the bottom of the bag, which is relatively narrow. The opposite end of the bag is opened and the pleated design permits the bag to be opened wide so as to fit around a relatively large amount of waste material. The loops of the bag slide over the jaws so that the bag may be held on the device and opened and closed as the jaws are opened and closed. The disposable bag includes a resealable sealing mechanism for keeping the opening of the bag closed. The sealing mechanism may be a hook and loop fastener (such as a Velcro® fastener) or another similar mechanism capable of keeping the bag closed, but which may be sealed and unsealed multiple times.

In use, the pet owner first slides a retainer bag over the scooped jaws. The flattened main body of the bag fits between the jaws and, thus, the jaws must be opened slightly as the loops are slid onto each jaw. Then, in order to pick up a deposit of feces from the ground, the owner opens the jaws by squeezing the handle portions of the arms together causing a pivoting of the arms about the pivot point and an opening of the jaws. As the jaws open, the resealable sealing mechanism opens. For example, in a device equipped with Velcro® fasteners, the hook portion of the hook and loop fastener is released from the loop portion. The bag then opens with the jaws and once opened, the pet owner can scoop up the feces by positioning the open jaws around the feces and releasing the spring biased arms. The arms then close to scoop the feces into the disposable bag, engage the sealing mechanism, and retain the feces in the bag. The pet owner can then dispose of the filled bag by opening the jaws slightly and sliding the full bag off the jaws into a waste receptacle with a small flick of the wrist. Of course, the present invention may be used to remove wastes other than animal feces.

These and other objects and advantages of the present invention will become apparent from the detailed description, claims, and accompanying drawings.

DETAILED DESCRIPTION OF THE PREFERRED EMBODIMENTS

Figure 1:
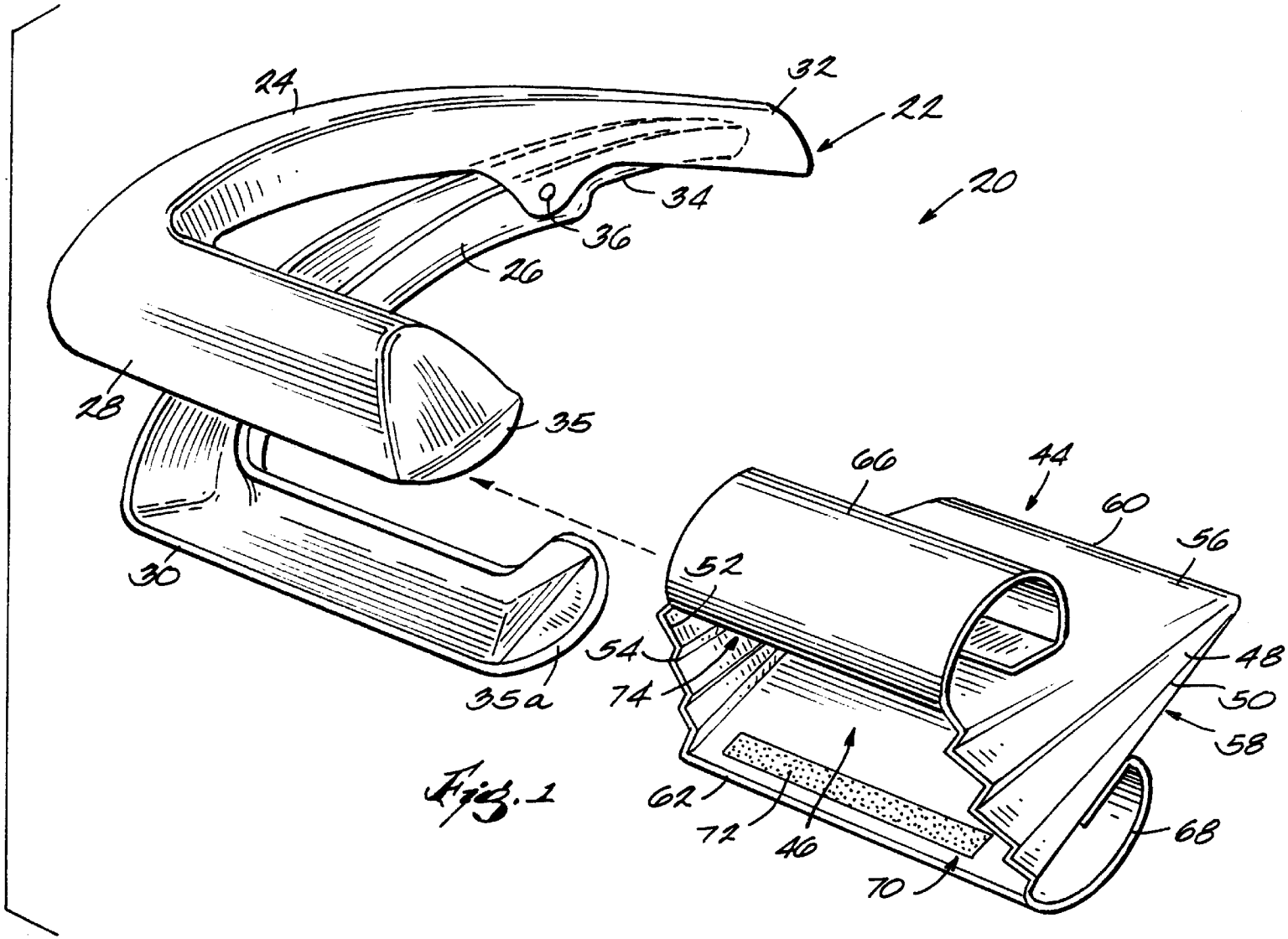
FIG. 1 is a perspective view of an animal waste removal system of the present invention showing the bag of the system removed from the scooper and a portion of the handle shown in phantom.

FIG. 1 shows a perspective view of one embodiment of the animal waste removal system (identified generally as 20) in accordance with the present invention. The waste removal system 20 includes a removal apparatus or scooper 22 having a pair of L-shaped arms 24 and 26. The arms 24 and 26 each have a scooped jaw 28 and 30 and a handle 32 and 34, respectively. Each jaw has a mouth 35 and 35*a,* respectively. The scooped jaws 28 and 30 also extend substantially perpendicularly from their respective arms 24 and 26. The handles 32 and 34 may be formed such that they are shaped to fit in a human hand and, thus, easy for the operator to grip and hold. The arms 24 and 26 are joined at a pivot 36 such that the arm 26 is positioned below the arm 24 and squeezing the handles 32 and 34 together effectuates opening of the jaws 28 and 30.

Figure 3:
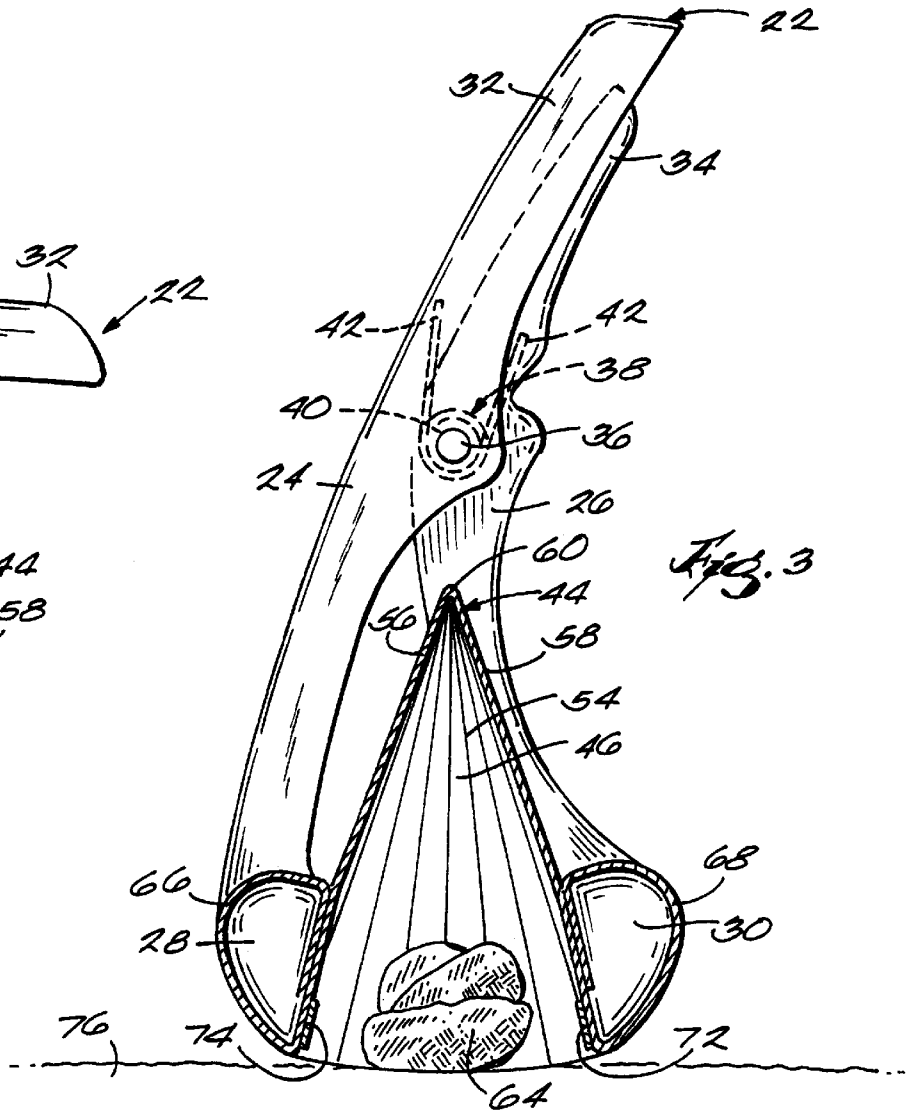
FIG. 3 is a partial cross-sectional view of the animal waste disposal system of the present invention taken generally along the line 3—3 of FIG. 2.
Figure 2:
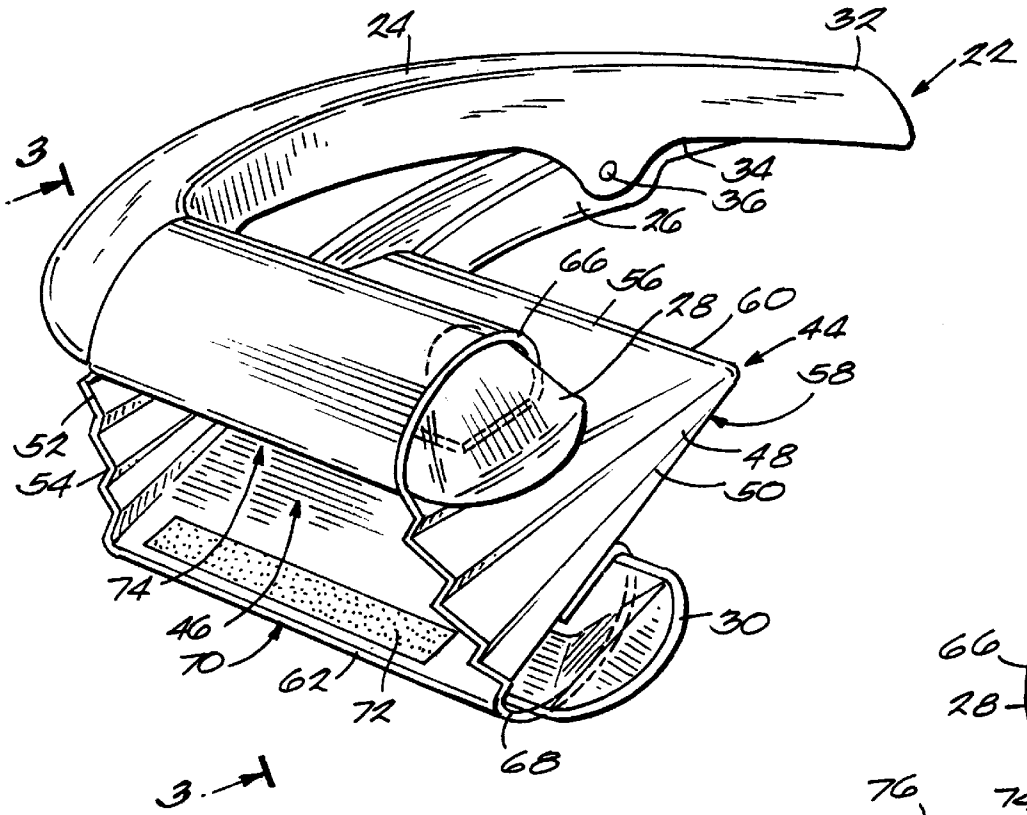
FIG. 2 is a perspective view of the animal waste disposal system of the present invention showing the bag of the system fitted on the scooper.
Figure 4:
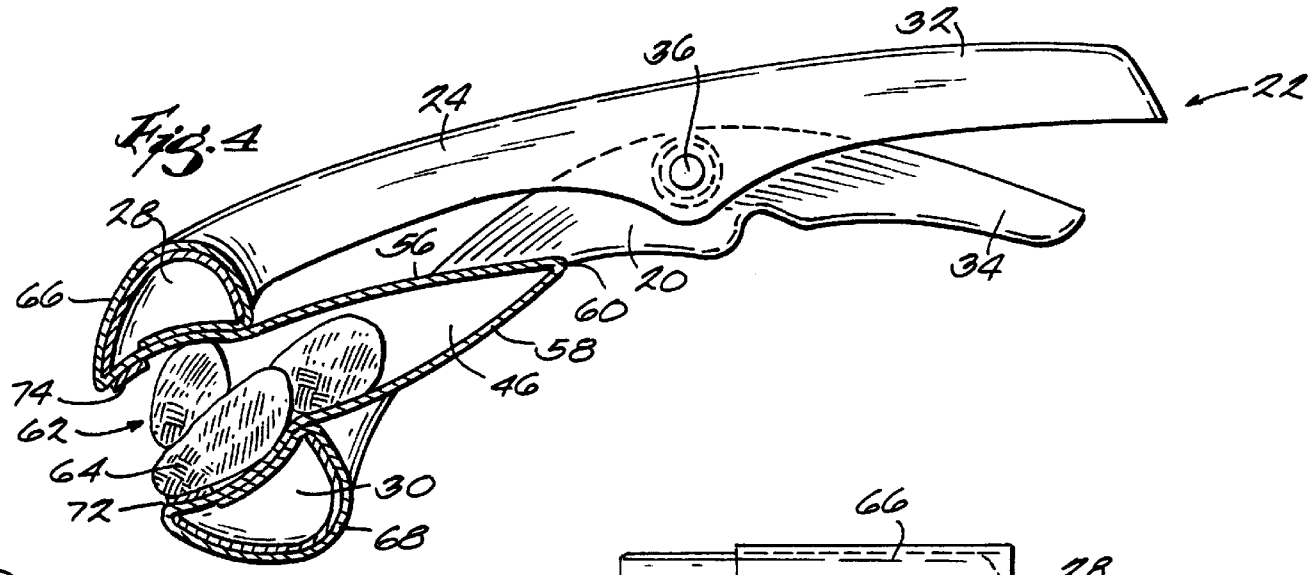
FIG. 4 is a partial cross-sectional view of the animal waste disposal system of the present invention with animal feces in the bag thereof.
Figure 6:
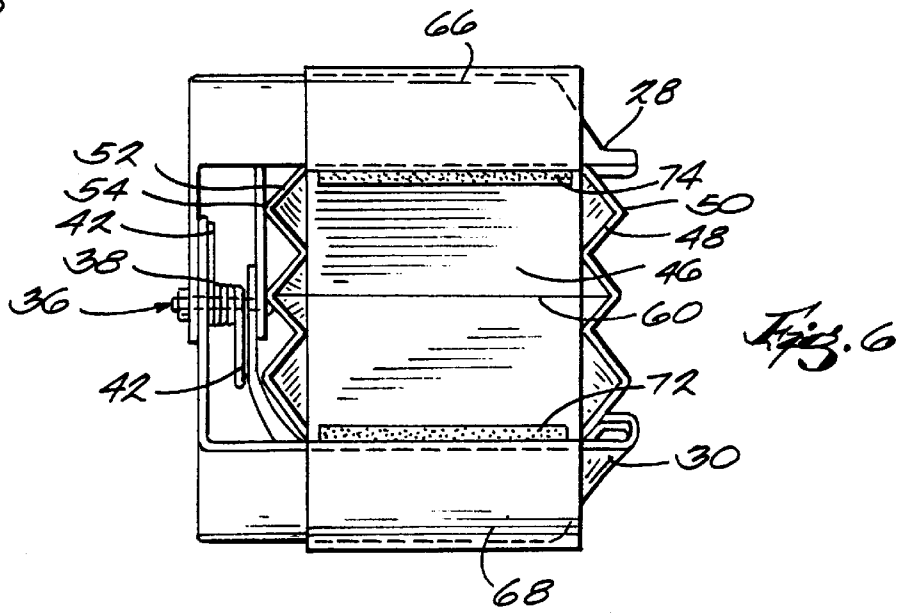
FIG. 6 is a bottom view of an animal waste removal system of the present invention.
Figure 5:
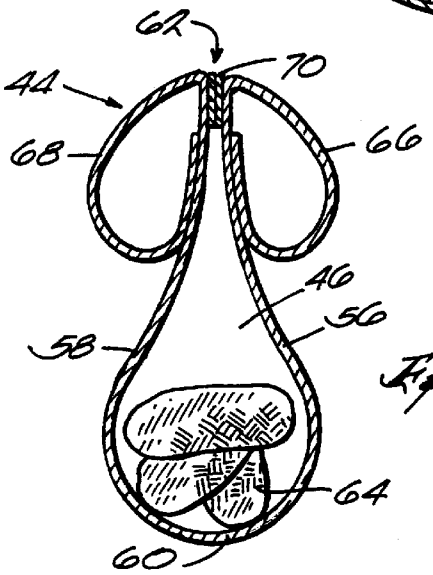
FIG. 5 is a cross-sectional view of the bag used in the animal waste removal system of the present invention with animal feces sealed therewithin.

A biasing mechanism such as a spring 38 (FIGS. 3 and 6) is positioned over the pivot 36 to bias the arms 24 and 26 in a closed position. If a spring 38 is used, it may effectuate the bias by including a coil portion 40 with biasing projections 42 extending therefrom that engage the arms 24 and 26. Of course, other types of biasing mechanism may be used to effectuate the objective of biasing the jaws 28 and 30 in a closed position, where the mouths 35 and 35*a* of the jaws 28 and 30 contact each other.

A paper, plastic, or other disposable waste retaining bag 44 is disengageably retained on the jaws 28 and 30 of the scooper 22. The waste retaining bag 44 has a pouch 46 with a first fan-folded or pleated side 48 having a plurality of pleats 50 and a second pleated side 52 with a plurality of pleats 54. The pouch 46 also has non-pleated, substantially smooth first and second sides 56 and 58, a top 60, and an opening 62 opposite the top 60. The pleats 50 and 54 meet at the top 60 in a manner that gives the bag 44 a triangular shape in cross-section and that permits the opening 62 to be opened very wide in comparison to the width of the top 60. Thus, the bag 44 is designed so that waste material 64 may be easily surrounded during the pick up operation. Further, the pleated design allows the bag 44 to be flattened for shipping and storage before use, but to expand in order to hold a relatively large amount of waste material 64 when used. The bag 44 is preferably formed from a paper, plastic, or other material constructed in the shape illustrated in the drawings.

The bag 44 has a pair of loops 66 and 68 positioned opposite one another and adjacent to the opening 62. The loop 66 is positioned on the first side 56 and the second loop 68 is positioned on the second side 58. Each of loops 66 and 68 is sized and shaped so that it can slide over one of the jaws 28 and 30.

The loops 66 and 68 hold the bag 44 on the jaws 28 and 30 in such a manner that opening of the jaws 28 and 30 results in opening of the bag 44. However, bag 44 also includes a resealable sealing mechanism 70 for sealing the opening 62 and, thus, keeping waste material 64 in the bag 44 once waste 64 is scooped therein. The resealable sealing mechanism 70 is positioned adjacent to the opening 62 and may be a hook 72 and loop 74 fastener (such as a Velcro® faster) or another fastener such as a pair of adhesive strips, a set of snaps, or other means capable of sealing the opening 62, but being opened and sealed multiple times.

In use, the pet owner first slides a bag 44 over the jaws 28 and 30 of the scooper 22. A slight opening of the jaws 28 and 30 may be required to slide the bag 44 over the jaws 28 and 30. Then, in order to pick up a deposit of feces 64 or other substance from the ground 76, the owner opens the jaws 28 and 30 by squeezing the handle portions 32 and 34 of the arms 24 and 26 together causing a pivoting of the arms 24 and 26 about the pivot point 36 and an opening of the jaws 28 and 30. Of course, in order for the jaws 28 and 30 to open, the hook portion 72 of the resealable sealing mechanism 70 must be released from the loop portion 74. Once the jaws 28 and 30 of the retainer bag 44 are opened, the pet owner can scoop up the feces 64 by positioning the open jaws 28 and 30 (FIG. 3) over the feces 64 and releasing the spring 38 biasing the arms 24 and 26. Of course, if a version of the scooper 22 without a spring 38 is used, the owner may have to manually close the jaws 28 and 30 by separating the handles 32 and 34. The arms 24 and 26 then close to scoop the feces or other waste material 64 into the pouch 46 of the bag 44 and engage the resealable sealing mechanism 70 to close the opening 62 and retain the waste material 64 in the bag 44. The pet owner can then dispose of the filled bag 44 by allowing it to slide off the jaws 28 and 30 into a waste receptacle (not shown). A slight opening of the jaws 28 and 30 and flick of the scooper 22 may be required in order to allow the bag 44 to slide off.

Because the loops 66 and 68 cover nearly all of each of the surfaces of the jaws 28 and 30, it is nearly impossible for the jaws 28 and 30 to become soiled during the pick up operation. Thus, the scooper 22 remains clean and may be stored without wrapping or cleaning it. Further, the scooper 22 may be grasped and fitted with another bag 44 to carry out another pick up operation. Thus, the use of a disposable waste bag 44 allows for repeated use of the waste material removal system 20 as well as convenient storage and handling without danger of soiling the storage area or hands of the operator with feces or other unsanitary matter 64.

As illustrated by the foregoing description and shown in the Figures, the present invention is more suitable as a sanitary animal waste material removal system than are conventional systems. Further, the present invention overcomes the limitations and disadvantages of existing systems by utilizing an effective design that can easily remove the waste material, is sanitary, and is inexpensive. However, although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims.

What is claimed is:

1. A waste material removal apparatus comprising:

a first L-shaped arm having a handle portion with a cavity, and a scooped jaw extending substantially perpendicularly from the arm, the jaw having a mouth and movable between an open position and a closed position;

a second L-shaped arm positioned below and pivotably connected at a pivot to the first L-shaped arm, the second L-shaped arm having a handle portion sized to fit within the cavity of the first L-shaped arm, and a scooped jaw extending substantially perpendicularly from the arm, the jaw having a mouth and movable between an open position and a closed position, wherein when each jaw is in its closed position the mouths are in contact with each other; and a bag having an opening, a pair of loops positioned adjacent to the opening, and a pouch, each loop sized to be removably and slidably disposed over one of the scooped jaws of the arms.

2. The waste material removal system of claim 1 further comprising a biasing mechanism for biasing the scooped jaws in a closed position.

3. The waste material removal system of claim 2 wherein the bag further comprises a resealable sealing mechanism.

4. The waste material removal system of claim 3 wherein the resealable sealing mechanism comprises a hook and loop fastener, the bag includes first and second sides, and the hook is on the first side of the bag and loop is on the second side of the bag.

5. The waste material removal system of claim 4 wherein the pouch of the bag has pleated ends.

6. An animal feces removal apparatus comprising:

a first L-shaped arm having a handle portion with a cavity, and a scooped jaw extending substantially perpendicularly from the arm, the jaw having a mouth and movable between an open position and a closed position;

a second L-shaped arm positioned below and pivotably connected at a pivot to the first L-shaped arm, the second L-shaped arm having a handle portion sized to fit within the cavity of the first L-shaped arm, and a scooped jaw extending substantially perpendicularly from the arm, the jaw having a mouth and movable between an open position and a closed position, wherein when each jaw is in its closed position the mouths are in contact with each other; and a biasing mechanism positioned near the pivot and for biasing each jaw in its closed position.

7. The animal feces removal system of claim 6 wherein the biasing mechanism is a spring positioned over the pivot.

8. The animal feces removal system of claim 7 further comprising a bag having a pair of loops, an opening, and a pouch, each loop sized and shaped to removably and slidably fit over one of the scooped jaws, wherein the bag further includes a resealable sealing mechanism positioned adjacent to the opening.

9. The animal feces removal system of claim 8 wherein the resealable sealing mechanism is a hook and loop fastener.

10. The animal feces removal system of claim 9 wherein the pouch of the bag has pleated ends.

11. A disposable bag for use in connection with an animal waste removal apparatus having two scooped jaws, the bag comprising;

a pouch having an opening, a first, triangular-shaped pleated side, a second, triangular-shaped pleated side, a first substantially smooth side, and a second substantially smooth side opposite the first substantially smooth side, and a top opposite the opening;

a first loop positioned on the first substantially smooth side adjacent to the opening, the first loop sized and shaped to slidably and releasably fit over one of the scooped jaws of the animal waste removal apparatus;

a second loop positioned on the second substantially smooth side adjacent to the opening, the second loop sized and shaped to slidably and releasably fit over one of the scooped jaws of the animal waste removal apparatus;

a first member of a resealable sealing mechanism positioned on the first substantially smooth side adjacent to the opening and opposite the first loop; and a second member of a resealable sealing mechanism positioned on the second substantially smooth side adjacent to the opening and opposite the second loop.

12. The bag of claim 11 wherein the resealable sealing mechanism is a hook and loop fastener.

13. The bag of claim 11 wherein the loops are sized and shaped to cover substantially all of the surface of the jaws.

14. A waste material removal system comprising:

a scooper including a first L-shaped arm having a handle portion with a cavity, and a scooped jaw extending substantially perpendicularly from the arm, the jaw having a mouth and movable between an open position and a closed position;

a second L-shaped arm positioned below and pivotably connected at a pivot to the first L-shaped arm, the second L-shaped arm having a handle portion sized to fit within the cavity of the first L-shaped arm, and a scooped jaw extending substantially perpendicularly from the arm, the jaw having a mouth and movable between an open position and a closed position wherein, when both jaws are in their closed positions the mouths are in contact with each other; and a bag including a pouch having an opening, a first, triangular-shaped pleated side, a second, triangular-shaped pleated side, a first substantially smooth side, and a second substantially smooth side opposite the first substantially smooth side, and a top opposite the opening;

a first loop positioned on the first substantially smooth side adjacent to the opening, the first loop sized and shaped to slidably and releasably fit over one of the scooped jaws of the animal waste removal apparatus; and a second loop positioned on the second substantially smooth side adjacent to the opening, the second loop sized and shaped to slidably and releasably fit over one of the scooped jaws of the animal waste removal apparatus.

* * * * *